US006181900B1

(12) United States Patent
Lee et al.

(10) Patent No.: US 6,181,900 B1
(45) Date of Patent: Jan. 30, 2001

(54) PHOTORECEPTOR BELT CONTROL APPARATUS FOR PRINTER

(75) Inventors: Jong-chan Lee, Suwon; Min-soo Lee, Uiwang; Jung-hun Bang, Suwon, all of (KR)

(73) Assignee: Samsung Electronics Co., Ltd., Kyungki-Do (KR)

( * ) Notice: Under 35 U.S.C. 154(b), the term of this patent shall be extended for 0 days.

(21) Appl. No.: 09/357,986

(22) Filed: Jul. 21, 1999

(30) Foreign Application Priority Data

Jul. 21, 1998 (KR) ..... 98-29284
Mar. 18, 1999 (KR) ..... 99-9179

(51) Int. Cl.[7] ..... G03G 15/00
(52) U.S. Cl. ..... 399/165; 198/806
(58) Field of Search ..... 399/165, 162; 198/806, 808; 226/170, 180, 174

(56) References Cited

U.S. PATENT DOCUMENTS

| | | | |
|---|---|---|---|
| 3,500,694 | 3/1970 | Jones et al. | 74/241 |
| 3,801,092 | 4/1974 | Jordan | 271/197 |
| 4,061,222 | 12/1977 | Rushing | 198/807 |
| 4,674,858 | 6/1987 | Nagayama . | |
| 5,078,263 | 1/1992 | Thompson et al. | 198/807 |
| 5,659,851 | 8/1997 | Moe et al. | 399/165 |
| 5,784,676 * | 7/1998 | Iseki et al. | 399/165 X |

FOREIGN PATENT DOCUMENTS

| | | |
|---|---|---|
| 0 818 715 | 1/1998 | (EP) . |
| 62-27209 | 5/1987 | (JP) . |

OTHER PUBLICATIONS

"Mechanism", edited by Betuyakumanai in Gihoutou publishing company, Mar. 15, Sho 50, p. 17, figure 1.

* cited by examiner

*Primary Examiner*—William J. Royer
(74) *Attorney, Agent, or Firm*—Sughrue, Mion, Zinn, Macpeak & Seas, PLLC

(57) ABSTRACT

A photoreceptor belt control apparatus for a printer having a photoreceptor belt that circulates around rollers rotatably installed on a belt frame. The apparatus includes a pair of auxiliary frames slidably and pivotally installed on the belt frame, and a steering roller whose ends are rotatably installed respectively on the auxiliary frames. The steering roller rotates in contact with the photoreceptor belt. A shaft is rotatably installed on the belt frame, and a cam unit is installed on at least one end of the shaft for controlling the inclination of the steering roller by pivoting each of the auxiliary frames according to the rotational position of the shaft. A tension control unit controls the tension in the photoreceptor belt by sliding the pair of auxiliary frames.

13 Claims, 9 Drawing Sheets

FIG. 4A
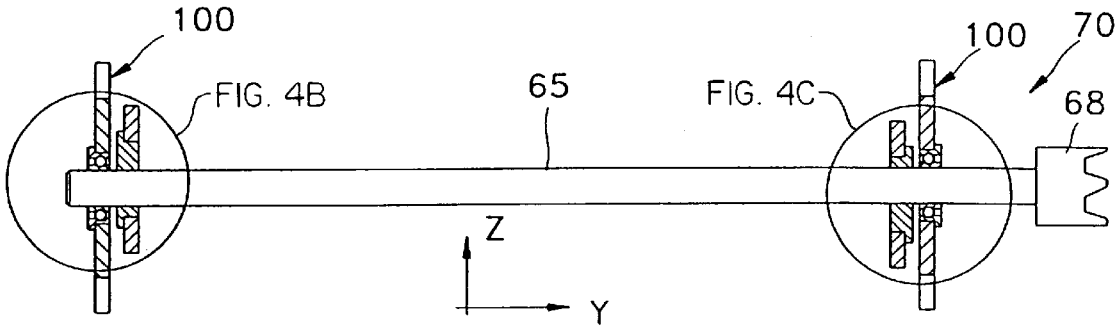
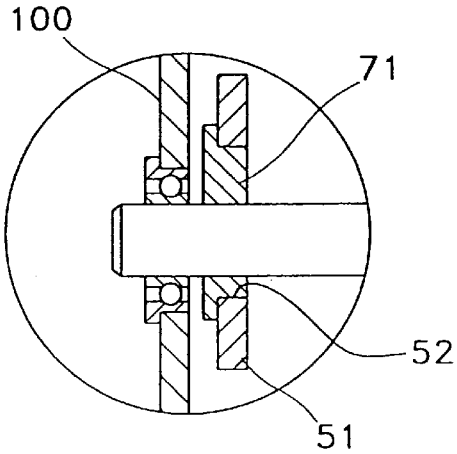
FIG. 4B
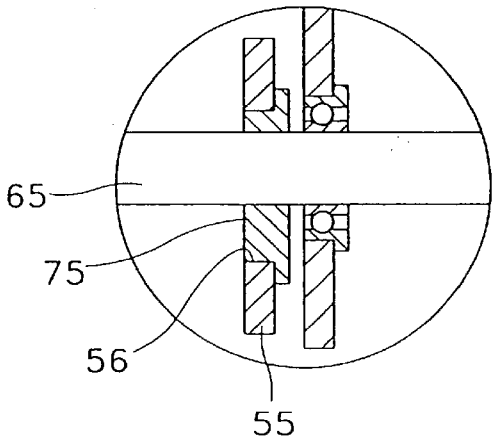
FIG. 4C

PHOTORECEPTOR BELT CONTROL APPARATUS FOR PRINTER

BACKGROUND OF THE INVENTION

1. Field of the Invention

The present invention relates in general to a photoreceptor belt control apparatus, for a printer, which steers a photoreceptor belt, and applies tension to and removes tension from the photoreceptor belt. More particularly, the present invention relates to a photoreceptor belt control apparatus for preventing the photoreceptor belt from traveling laterally, and for applying tension to and releasing tension from the photoreceptor belt by driving auxiliary frames that support a steering roller.

2. Description of the Related Art

A general printer, such as a laser printer, forms a latent electrostatic image by scanning a photoreceptor belt using a laser scanning unit, develops the latent electrostatic image with a color ink using a developing unit, and transfers the developed image onto a printing paper.

Referring to FIG. 1, a general printer includes a photoreceptor belt 10 that circulates continuously around a set of rollers 12, 14 and 21 installed in the main body of the printer. The general printer further includes an erase lamp 15 for erasing a surface potential formed on the photoreceptor belt 10, a charger 17 for charging the photoreceptor belt 10 with a predetermined potential, a plurality of laser scanning units (LSU) 18 for scanning the photoreceptor belt 10 with laser beams to form latent electrostatic images for respective colors, and a plurality of developing units 19 for developing the latent electrostatic images.

As the photoreceptor belt 10 circulates around the rollers 12, 14 and 21, it tends to travel laterally, i.e., in the length direction of the rollers 12, 14, and 21. Also, it is necessary to release the tension in the photoreceptor belt 10, for example, upon attachment and detachment of a belt unit including the photoreceptor belt 10 and the rollers 12, 14, and 21.

Referring to FIGS. 1 and 2, a conventional photoreceptor belt control apparatus for the general printer includes a photoreceptor belt steering unit 20 for correcting the lateral travel of the photoreceptor belt 10 on the basis of information detected by a lateral travel detector (not shown), and a tension applying/releasing unit 40 for controlling the tension in the photoreceptor belt 10.

The photoreceptor belt steering unit 20 includes a frame 23 installed on a printer main body 1, a pivot member 25 pivotally installed on the frame 23, a steering roller 21 installed on the pivot member 25 for supporting the photoreceptor belt 10 so that the photoreceptor belt 10 rotates along a fixed path, a pair of stable rollers 27 installed on the frame 23 to prevent the photoreceptor belt 10 from being crumpled as it passes over the steering roller 21, and a control unit 30 installed on the printer main body 1 for controlling the upward and downward (direction indicated by arrow A) tilt of the steering roller 21.

The tension applying/releasing unit 40 includes a guide bar 41 with one end hinged to the center of the pivot member 25, a first cam member 43, an elastic member 45 installed on the outer circumference of the guide bar 41, the elastic member 45 having ends that respectively contact the first cam member 43 and the frame 23, and a control knob 47 for controlling the first cam member 43. The control knob 47 controls the elasticity of the elastic member 45 to adjust the pressure of the steering roller 21 against the photoreceptor belt 10, thereby adjusting the tension in the photoreceptor belt 10.

The pivot member 25 is coupled to the guide bar 41 by a coupling pin 39, and pivots in an X-Y plane about the coupling pin 39. The pivot member 25 pivots in a direction to compensate for an unbalanced pressure that the steering roller 21 applies against the photoreceptor belt 10. A sliding plate 46 is slidably installed on the outer circumference of the guide bar 41 so as to compress the elastic member 45 according to the rotation position of the first cam member 43.

A shaft 21*a* of the steering roller 21 is inserted into a holding hole 25*a* formed in the pivot member 25. An elastic piece 26, for pressing the shaft 21*a* of the steering roller 21 into the holding hole 25*a*, is installed on the pivot member 25 adjacent to the holding hole 25*a*.

The control unit 30 includes a driving motor 31 fixed to the printer main body 1, a second cam member 33 whose center is combined with a shaft 31*a* of the driving motor 31, the second cam member 33 having a cam hole 33*a*, and a rotating guide protrusion 35 coupled to the pivot member 25 and inserted into the cam hole 33*a*. The position of the cam hole 33*a* varies with the rotation of the driving motor 31, thereby changing the relative position of the rotating guide protrusion 35. The steering roller 21 pivots on the guide bar 41 in the direction indicated by arrow A.

When a lateral travel degree of the photoreceptor belt 10 is detected by the lateral travel detector, the second cam member 33 rotates to adjust the tilt of the steering roller 21. The tilt of the steering roller 21 causes the photoreceptor belt 10 to return to its initial lateral position. In this way, the lateral travel of the photoreceptor belt 10 is corrected.

The pair of stable rollers 27 are installed parallel to the steering roller 21, and respectively contact a portion of the photoreceptor belt 10 heading for the steering roller 21 and a portion of the photoreceptor belt 10 that has passed across the steering roller 21. These stable rollers 27 prevent the photoreceptor belt 10 from crumpling.

Although generally thought to be acceptable, the conventional photoreceptor belt control apparatus is not without shortcomings. In particular, the steering roller 21 pivots about the coupling pin 39, which is located at the end of the guide bar 41. This pivoting action requires structure that occupies valuable internal space in a printer main body. The structure includes the pivot member 25, guide bar 41, and frame 23. Thus, the miniaturization of the photoreceptor belt control apparatus is limited.

Also, the first cam member 43 adjusts the elastic force applied to the guide bar 41, and thus the tension in the photoreceptor belt 10 is adjustable. This conventional structure, however, does not allow a convenient retreating movement of the steering roller 21 in the direction indicated by arrow X.

SUMMARY OF THE INVENTION

To solve the above problems, the present photoreceptor belt control apparatus for a printer controls the tension in the photoreceptor belt by driving auxiliary frames installed on both ends of a steering roller, thereby guiding the tilt of the steering roller.

Accordingly, there is provided a photoreceptor belt control apparatus for a printer designed to correct lateral travel of a photoreceptor belt supported by rollers rotatably installed on a belt frame, and/or to control the tension of the photoreceptor belt. The apparatus comprises: a belt frame; a pair of auxiliary frames slidably and pivotally installed on the belt frame; a steering roller whose ends are rotatably installed respectively on the auxiliary frames, the steering roller rotating in contact with the photoreceptor belt; a shaft whose ends are rotatably installed on the belt frame; a cam unit installed on at least one end of the shaft for controlling the inclination of the steering roller by pivoting each of the auxiliary frames according to the rotational position of the shaft; and a tension control unit for controlling tension in the photoreceptor belt by sliding the pair of auxiliary frames.

BRIEF DESCRIPTION OF THE DRAWINGS

The above objectives and advantages of the present invention will become more apparent by describing in detail preferred embodiments thereof with reference to the attached drawings in which:

FIG. 4 is a cross-sectional view taken along line IV—IV of FIG. 3;

DESCRIPTION OF THE PREFERRED EMBODIMENTS

Figure 1:
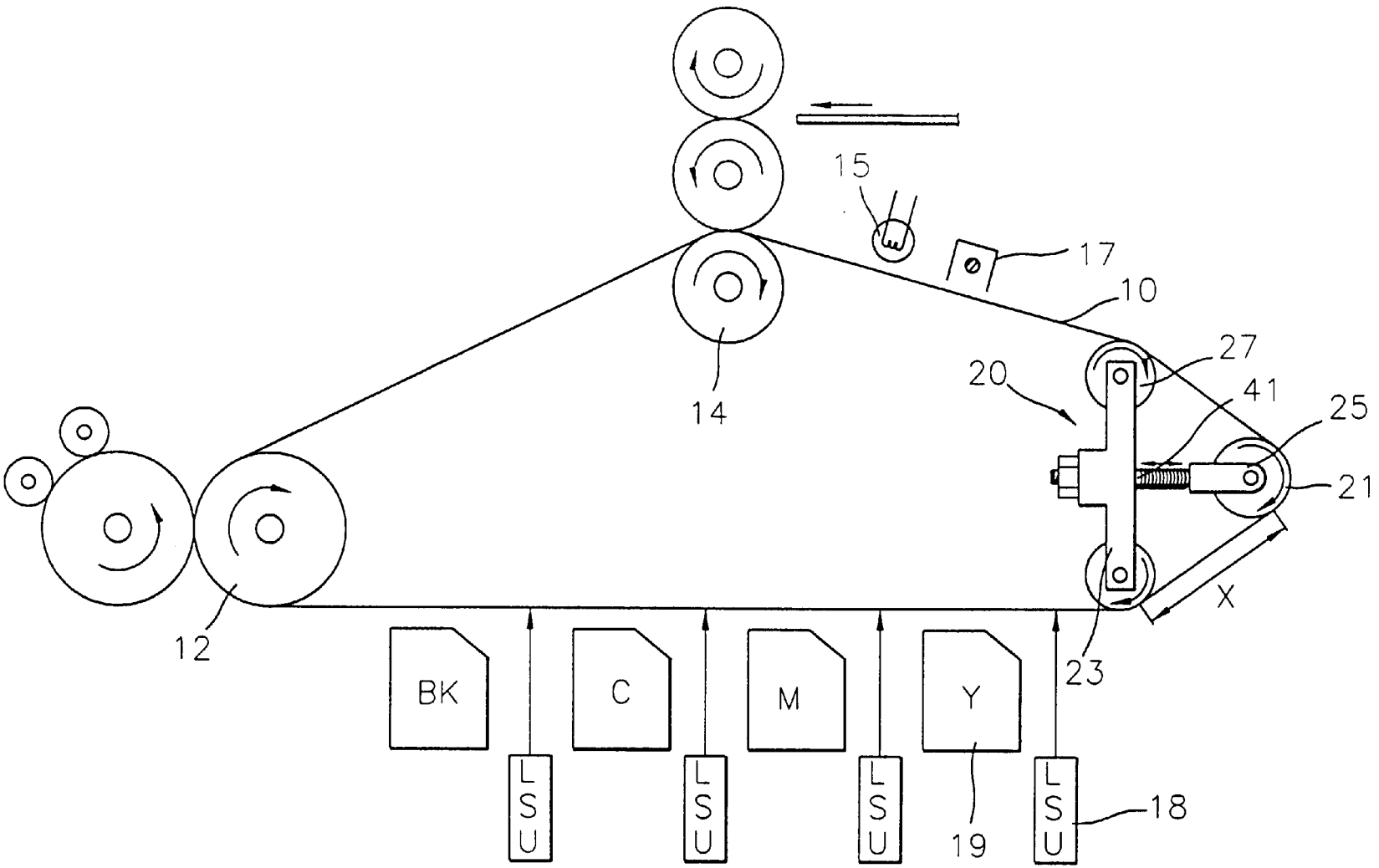
FIG. 1 (PRIOR ART)
FIG. 1 is a schematic view illustrating a printer with a conventional photoreceptor belt control apparatus.
Figure 2:
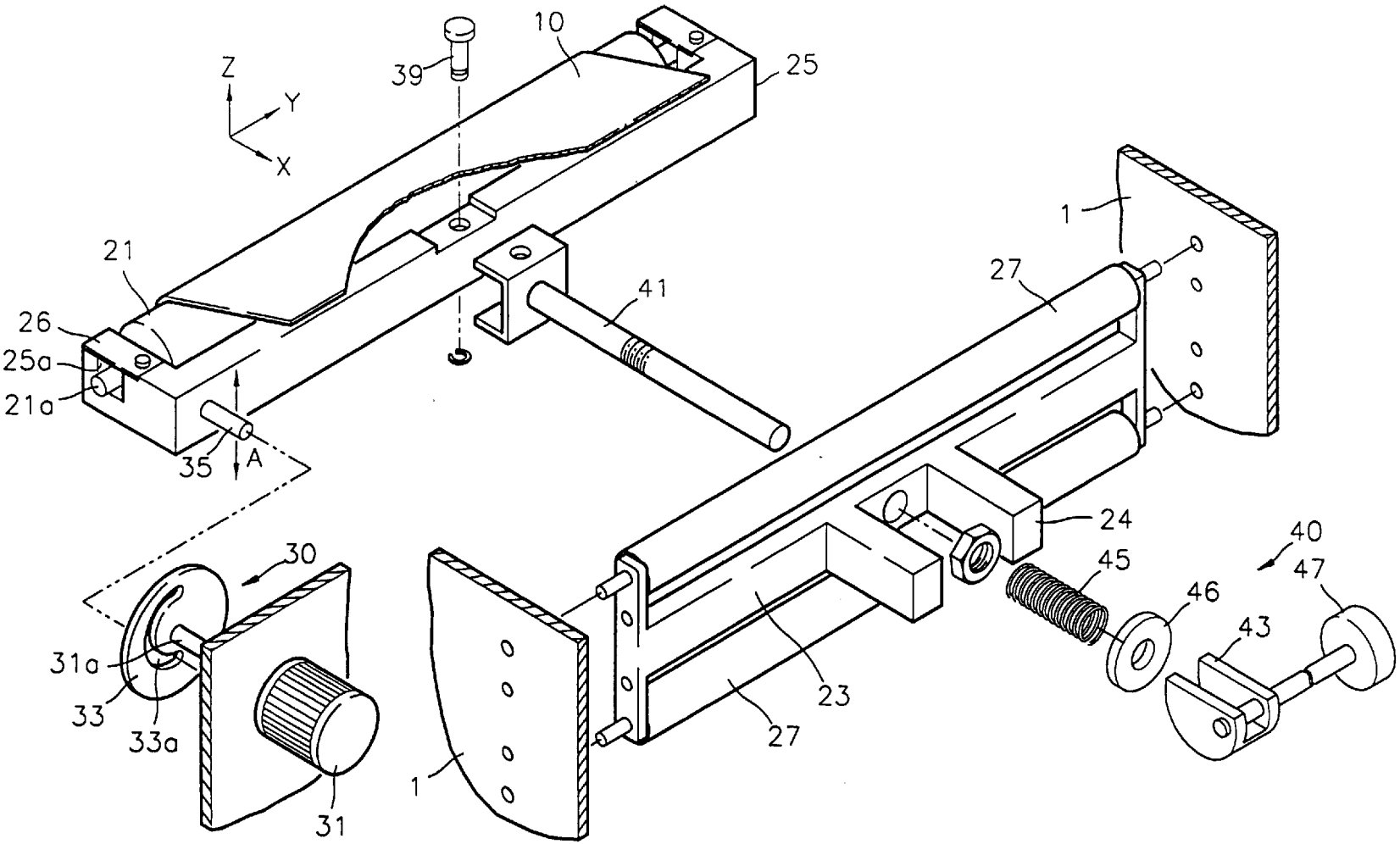
FIG. 2 (PRIOR ART)
FIG. 2 is a schematic exploded perspective view illustrating a conventional photoreceptor belt control apparatus.
Figure 3:
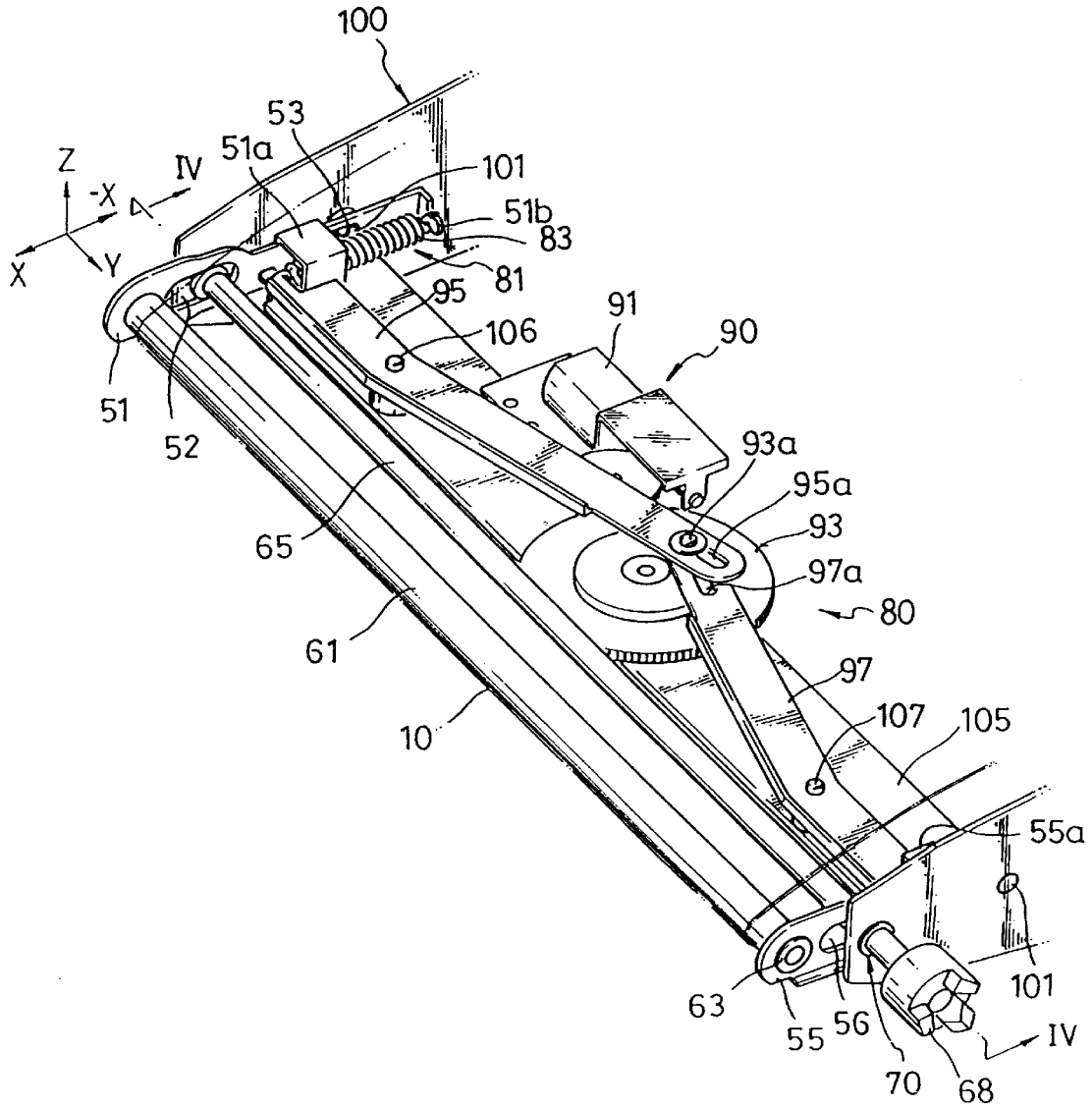
FIG. 3 is a perspective view illustrating a photoreceptor belt control apparatus for a printer according to an embodiment of the present invention.

Referring to FIGS. 3 and 4, the photoreceptor belt control apparatus includes first and second auxiliary frames 51 and 55, respectively, a steering roller 61 pivotally installed on the ends of the auxiliary frames 51 and 55, a shaft 65 having the ends thereof pivotally installed on a belt frame 100, a cam unit 70 installed on at least one end of the shaft 65 for adjusting the inclination of the steering roller 61 according to the rotation position of the shaft 65 by pivoting at least one of the auxiliary frames 51 and 55, and a tension control unit 80 for controlling the tension in the photoreceptor belt 10 by sliding the auxiliary frames 51 and 55 in advancing and retreating directions (X and −X directions, respectively) relative to the belt frame 100.

Figure 7:
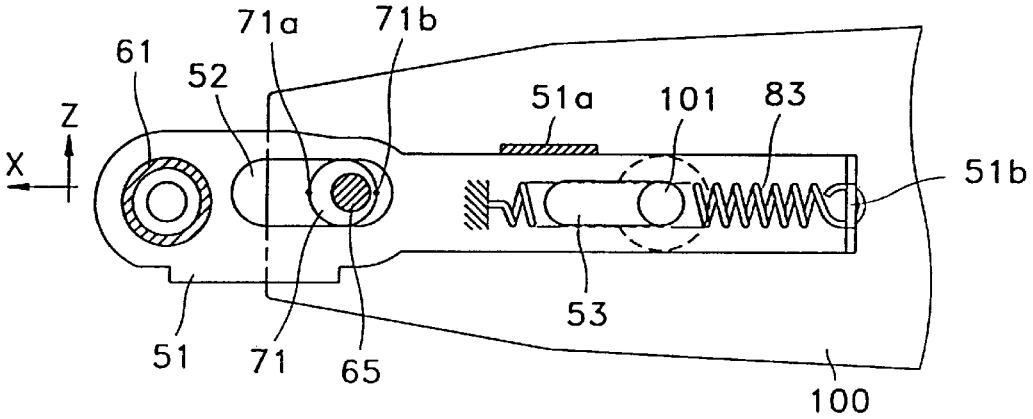

The auxiliary frames 51 and 55 are slidably installed on the belt frame 100. When advanced (slid in the direction of arrow X), the auxiliary frames 51 and 55 increase the tension in the photoreceptor belt 10; and when retreated (slid in the direction of arrow −X), the auxiliary frames 51, 55 reduce the tension in the photoreceptor belt 10. First and second elevating guide holes 52 and 56, respectively, which are component elements of the cam unit 70, are formed in the first and/or second auxiliary frames 51 and 55, respectively. Also, first and second guide holes 53 and 57 (see FIG. 7), respectively, for guiding the sliding action of the auxiliary frames 51 and 55, are formed in the first and/or second auxiliary frames 51 and 55, respectively.

The steering roller 61 is rotatably installed between the ends of the auxiliary frames 51 and 55. A bearing 63 is installed between the steering roller 61 and each of the auxiliary frames 51 and 55.

The steering roller 61 contacts the photoreceptor belt 10, and is rotated by the travel of the photoreceptor belt 10. The ends of the steering roller 61 are movable by the cam unit 70 in opposite directions, such that the steering roller 61 corrects the lateral travel of the photoreceptor belt 10. The shaft 65 has ends rotatably installed on the belt frame 100, and the cam unit 70 is installed on at least one end of the shaft 65. The rotating direction of the shaft 65 is controlled by an external driving source installed on a printer main body (not shown). It is preferable to provide a coupler 68 on an end of the shaft 65 to transmit a rotational force from the external driving source to the shaft 65. The addition of the coupler 68 facilitates separation and coupling of the belt frame 100 from and to the printer main body.

The cam unit 70 is installed on at least one end of the shaft 65 and controls the inclination of the steering roller 61 by pivoting the first and/or second auxiliary frames 51 and 55, respectively, according to the rotating position of the shaft 65.

FIG. 4 shows an embodiment of the invention in which the cam unit 70 is installed on both ends of the shaft 65. Specifically, the cam unit 70 includes first and second cam members 71 and 75, respectively, installed on the ends of the shaft 65. The cam members 71 and 75 are respectively received by the elevating guide holes 52 and 56, which are respectively formed in the auxiliary frames 51 and 55. The cam members 71 and 75 are eccentric from the center of the shaft 65. The elevating guide holes 52 and 56 are slot-shaped, with their longitudinal axes extending along the sliding direction (X direction) of the auxiliary frames 51 and 55. The elevating guide holes 52 and 56 also have predetermined widths in a direction indicated by arrow Z, such that the opposing longitudinal surfaces (the upper and lower surfaces in FIG. 3) of the elevating guide holes 52 and 56 contact the outer circumference of the cam members 71 and 75.

The auxiliary frames 51 and 55 pivot in an X-Z plane about coupling protrusions 101 extending from the belt frame 100. This pivot action is imparted according to the radial portions of the cam members 71 and 75 contacting the opposing longitudinal surfaces of the elevating guide holes 52 and 56. It is preferable that the first cam member 71 has the same size and shape as the second cam member 75, and the first elevating guide hole 52 has the same size and shape as the second elevating guide hole 56. Also, preferably, the long radius portion and short radius portion of the first cam member 71 are offset 180° from those of the second cam member 75.

Accordingly, when the shaft 65 rotates, one auxiliary frame, e.g., the first auxiliary frame 51, pivots clockwise about the coupling protrusion 101 in the X-Z plane, while the other auxiliary frame, e.g., the second auxiliary frame 55, pivots counterclockwise about the coupling protrusion 101 in the X-Z plane. Therefore, both ends of the steering roller 61 axially pivot in the Y-Z plane (FIG. 3).

Referring to FIG. 3, the tension control unit 80 includes an elastic biasing means 81 for elastically biasing the auxiliary frames 51 and 55 with respect to the belt frame

100, and a driving means 90 that selectively regulates the elastic force applied to the auxiliary frames 51 and 55 by the elastic biasing means 81.

The driving means 90 includes a driving source 91 for providing a driving force, a driving plate 93 that rotates by receiving the driving force from the driving source 91, and first and second lever members 95 and 97, respectively. The lever members 95 and 97 respectively press against the auxiliary frames 51 and 55. The driving source 91 and the driving plate 93 are installed on a fixing plate 105, which is installed on the belt frame 100.

The driving plate 93 is rotatably installed on the fixing plate 105, and rotates by receiving power from the driving source 91. The lever members 95 and 97 are pivotally mounted on the fixing plate 105 via respective hinges 106 and 107. The lever members 95 and 97 have first ends coupled to the driving plate 93, so as to pivot when the driving plate 93 rotates. Specifically, a driving protrusion 93*a* extends from the driving plate 93 at a position eccentric from the rotational center of the driving plate 93. This driving protrusion 93*a* is received by slots 95*a* and 97*a* formed respectively in the first ends of the lever members 95 and 97. Thus, when the driving plate 93 rotates, the lever members 95 and 97 respectively pivot about the hinges 106 and 107, according to the position of the driving protrusion 93*a*.

The lever members 95 and 97 also have second ends that cooperate with the auxiliary frames 51 and 55. Specifically, when the tension in the photoreceptor belt 10 is to be removed, e.g., to replace the photoreceptor belt 10, the second ends of the lever members 95 and 97 respectively contact the auxiliary frames 51 and 55, and force the auxiliary frames 51 and 55 to retreat in the direction indicated by −X. This retreating movement reduces the tension in the photoreceptor belt 10. On the other hand, in a normal case, e.g., a printing mode, the second ends of the lever members 95 and 97 are spaced apart from the auxiliary frames 51 and 55, such that the auxiliary frames 51 and 55 are elastically biased in the X direction by the elastic biasing means 81 Thus, the steering roller 61 maintains tension in the photoreceptor belt 10.

Preferably, guide brackets 51*a* and 55*a* are respectively formed on the auxiliary frames 51 and 55. These guide brackets 51*a* and 55*a* are located to respectively contact the second ends of the lever members 95 and 97.

Figure 8:
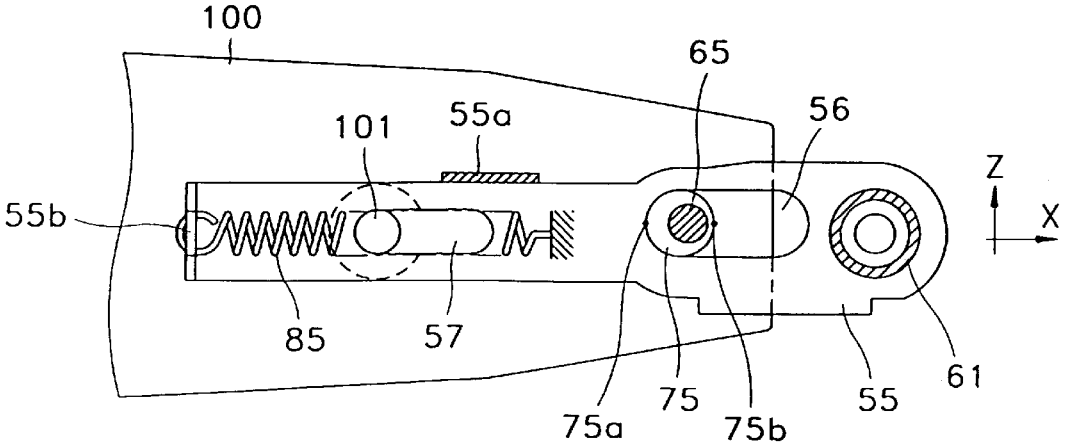

As shown in FIG. 3, the elastic biasing means 81 respectively interposes between each of the lever members 95 and 97 and each of the auxiliary frames 51 and 55, and elastically biases the steering roller 61 in the advancing direction, i.e., the direction in which the tension of the photoreceptor belt 10 increases. The elastic biasing means 81 comprises first and second elastic members 83 and 85 (see FIG. 8), respectively, for elastically biasing the auxiliary frames 51 and 55 with respect to the belt frame 100, and a pair of coupling protrusions 51*b* and 55*b* (see FIG. 8) formed respectively on the auxiliary frames 51 and 55. The elastic members 83 and 85, which may be typical tension springs, respectively extend between the coupling protrusions 51*b* and 55*b* and the lever members 95 and 97. It is to be appreciated that the movements of the coupling protrusions 51*b* and 55*b* and the lever members 95 and 97 are reversible, even when the tension in the photoreceptor belt 10 is released. These reversible movements prevent the forces applied against the first and second elastic members 83 and 85 from increasing to a point at which the elastic members 83 and 85 are permanently deformed.

Figure 5:
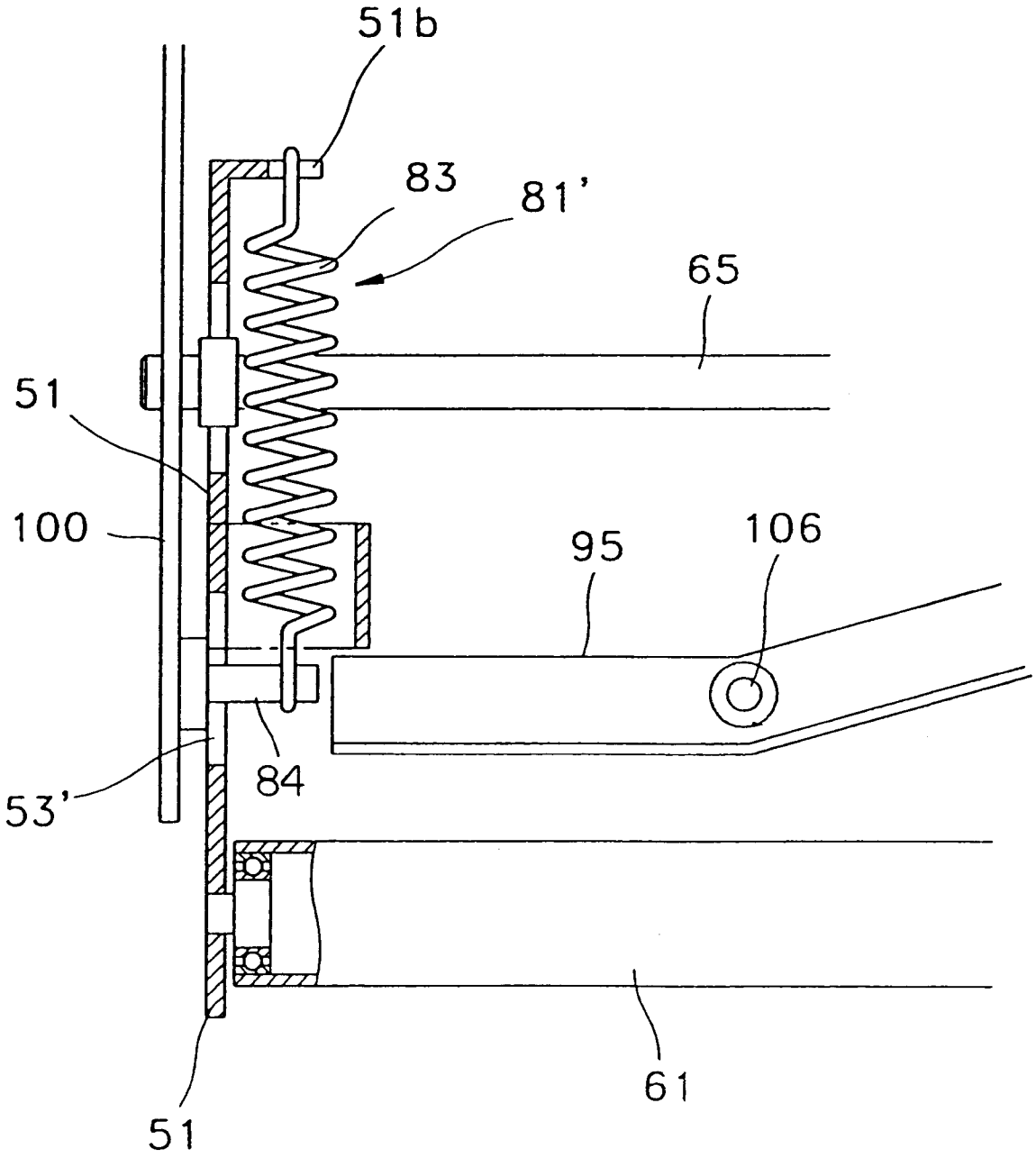
FIG. 5 is a partially extracted view illustrating a photoreceptor belt control apparatus for a printer according to another embodiment of the present invention.
Figure 6:
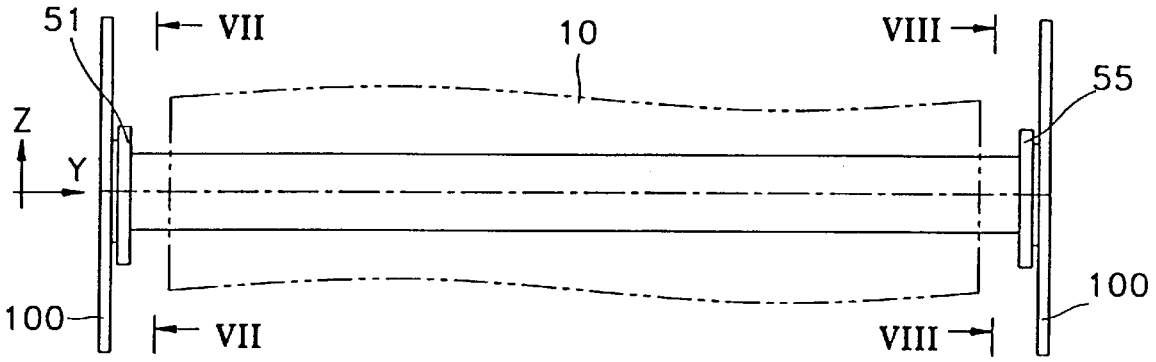
FIGS. 6 through 8 are schematic views illustrating the relative positions of the elements of the photoreceptor belt control apparatus shown in FIG. 3, when the photoreceptor belt travels normally.

FIG. 5 illustrates another embodiment of an elastic biasing means 81'. The elastic biasing means 81' is installed on both auxiliary frames 51 and 55. For convenience, however, installation of the elastic biasing means 81' for only the first auxiliary frame 51 is described as follows.

The elastic biasing means 81' includes an elastic member 83 for elastically biasing the auxiliary frame 51 with respect to the belt frame 100, a first coupling protrusion 84 that protrudes from the belt frame 100 and is coupled to one end of the elastic member 83, and a second coupling protrusion 51*b* that protrudes from the auxiliary frame 51 and is coupled to the other end of the elastic member 83. The first coupling protrusion 84 protrudes through a guide 53' formed in the auxiliary frame 51. The first coupling protrusion 84 is the rotational center of the auxiliary frame 51.

In FIG. 5, the shaft 65 is installed between the first and second coupling protrusions 84 and 51*b*, respectively, but it can also be installed between the first coupling protrusion 84 and the steering roller 61. Preferably, the first and second coupling protrusions 84 and 51*b*, respectively, and the elastic member 83 are installed on the second auxiliary frame 55 in the same manner as on the first auxiliary frame 51.

The operation of the photoreceptor belt control apparatus according to an embodiment of the present invention is described below, with respect to a steering operation and a tension control operation.

The steering operation is described with reference to FIGS. 6 through 11, which illustrate the relative positions of the elements of the photoreceptor belt control apparatus, when the photoreceptor belt travels normally. Specifically, the long radius end 71*a* and the short radius end 71*b* of the first cam member 71 are aligned along the longitudinal axis of the first elevating guide hole 52, and the long radius end 75*a* and the short radius end 75*b* of the second cam member 75 are aligned along the longitudinal axis of the second elevating guide hole 56. Thus, the auxiliary frames 51 and 55 are parallel to each other, and the steering roller 61 is parallel to the Y axis in FIG. 6.

Figure 9:
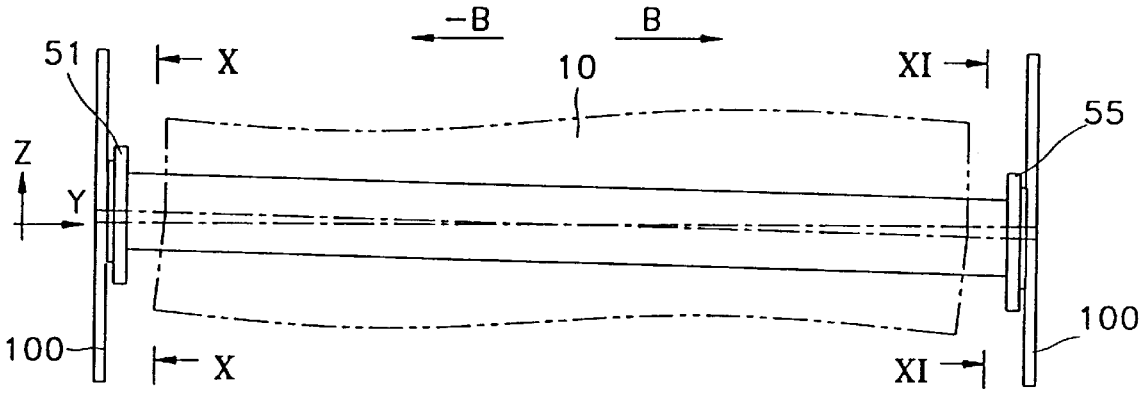
FIGS. 9 through 11 are schematic views illustrating the relative positions of the elements of the photoreceptor belt control apparatus shown in FIG. 3, when the photoreceptor belt travels laterally.
Figure 10:
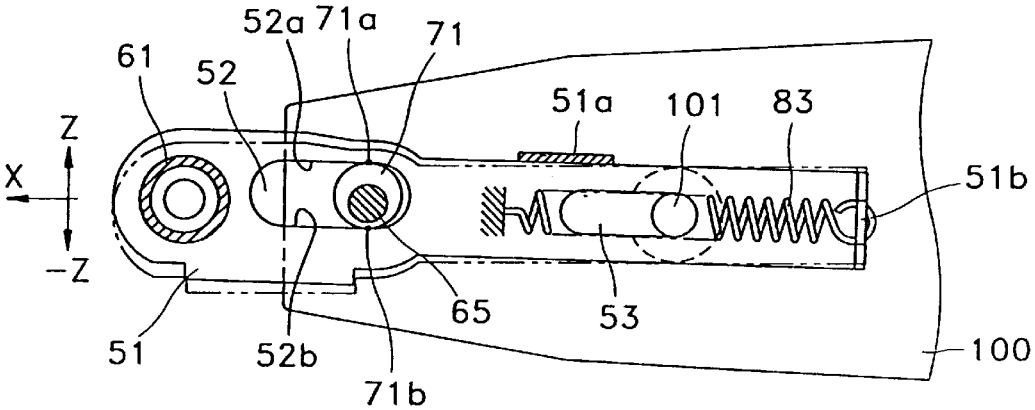
Figure 11:
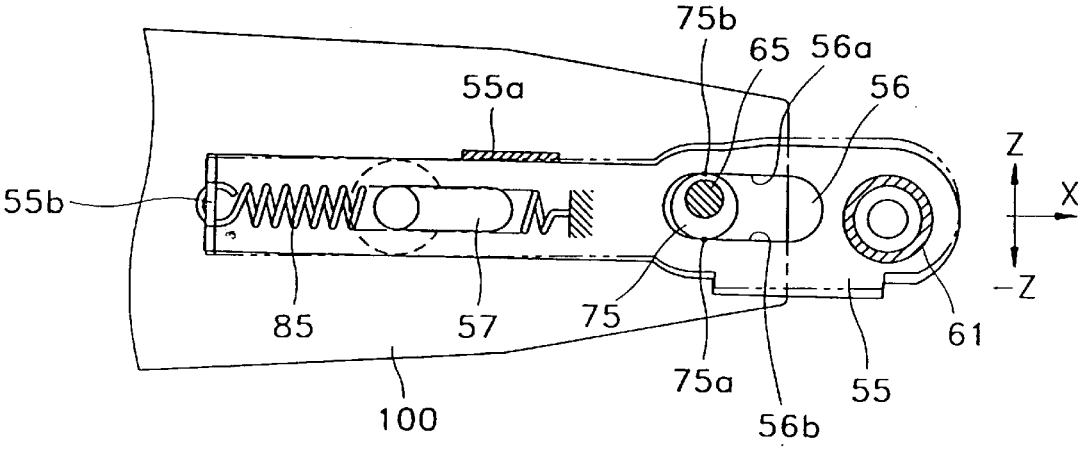

FIGS. 9 through 11 illustrate the photoreceptor belt control apparatus positioned to steer the photoreceptor belt 10 in the direction indicated by arrow −B, which is necessary when the photoreceptor belt 10 travels laterally in the direction indicated by arrow B. Specifically, the shaft 65 is rotated from the position shown in FIGS. 6–8, such that the long radius end 71*a* and the short radius end 71*b* of the first cam member 71 respectively contact the opposed longitudinal surfaces 52*a* and 52*b* of the first elevating guide hole 52, and the long radius end 75*a* and the short radius end 75*b* of the second calm member 75 respectively contact the opposed longitudinal surfaces 56*b* and 56*a* of the second elevating guide hole 56.

Accordingly, the first auxiliary frame 51 is rotated through a predetermined angle about the coupling protrusion 101, thereby moving the end of the steering roller 61 in the direction indicated by arrow Z; and the second auxiliary frame 55 is rotated through a predetermined angle about the coupling protrusion 101, thereby moving the end of the steering roller 61 in the direction indicated by arrow −Z. When the auxiliary frames 51 and 55 are viewed from the far right in FIG. 9, the directions of the rotational movements are clockwise for the first auxiliary frame 51, and counterclockwise for the second auxiliary frame 55. Thus, the steering roller 61 is inclined to move the photoreceptor belt 10 in the direction indicated by arrow -B, thereby correcting the lateral travel of the photoreceptor belt 10 in the direction indicated by arrow B.

On the other hand, when the photoreceptor belt 10 travels laterally in the direction indicated by arrow -B, the cam members 71 and 75 are rotated to move the auxiliary frames 51 and 55 in respective directions which are opposite to those described with reference FIGS. 9 through 11. Accordingly, the steering roller 61 is inclined to move the photoreceptor belt 10 in the direction indicated by arrow B, thereby correcting the lateral travel of the photoreceptor belt 10 in the direction indicated by arrow –B.

As shown in FIGS. 3 and 6 through 11, the cam unit 70 includes two cam members 71 and 75 respectively installed on the auxiliary frames 51 and 55. It is to be appreciated, however, that the cam unit 70 may include a single cam member installed on either one of the auxiliary frames 51 or 55. The basic operating principle of the cam unit 70 having the single cam member is the same as that described above. Thus, a detailed discussion of the operation of the single cam member is omitted.

Figure 12:
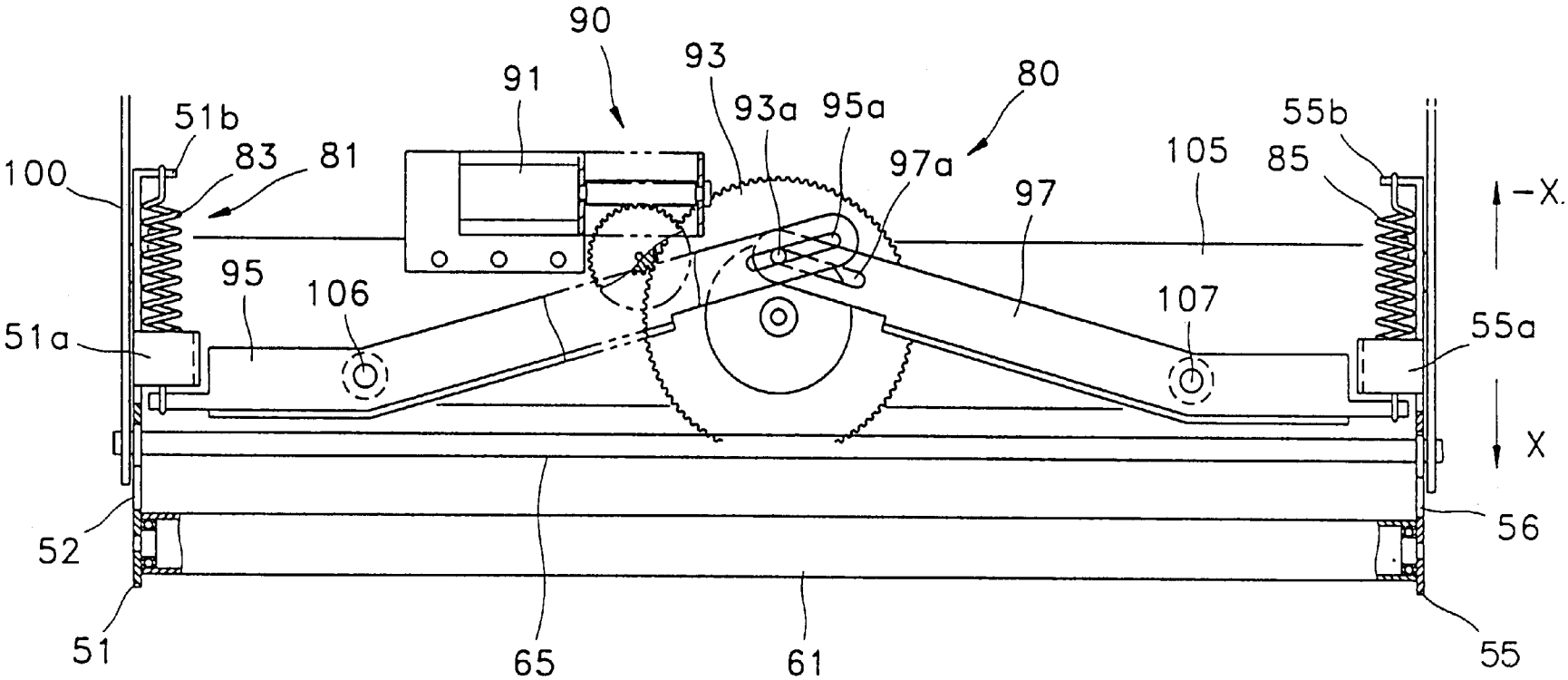
FIG. 12 is a schematic plan view of a photoreceptor belt tension control apparatus positioned to create tension in a photoreceptor belt, according to the present invention.

The operation of the tension control means 90 is described with reference to FIGS. 12 and 13. FIG. 12 shows the photoreceptor belt tension control apparatus in a position that creates tension in the photoreceptor belt 10. Specifically, the driving source 91 rotates the driving plate 93, such that the second ends (the outermost ends) of the lever members 95 and 97 advance in the direction indicated by arrow X. The auxiliary frames 51 and 55, which are respectively coupled to the lever members 95 and 97 by the elastic members 83 and 85, also advance in the direction of arrow X. Eventually, the steering roller 61 abuts against the photoreceptor belt 10, thus stopping the advancing movements of the auxiliary frames 51 and 55. At this point, the second ends (the outermost ends) of the lever members 95 and 97 continue to advance, amid therefore respectively separate from the auxiliary frames 51 and 55. In this condition, the elastic members 83 and 85 respectively elastically bias the auxiliary frames 51 and 55 in the direction of arrow X, thereby creating tension in the photoreceptor belt 10. Therefore, if an external force creates additional tension in the photoreceptor belt 10, the steering roller 61 partially retreats in the direction indicated by arrow –X, against the influence of the elastic members 83 and 85. On the other hand, if an external force reduces the tension in the photoreceptor belt 10, the force of the elastic members 83 and 85 further advances the steering roller 61 in the direction indicated by arrow X.

Figure 13:
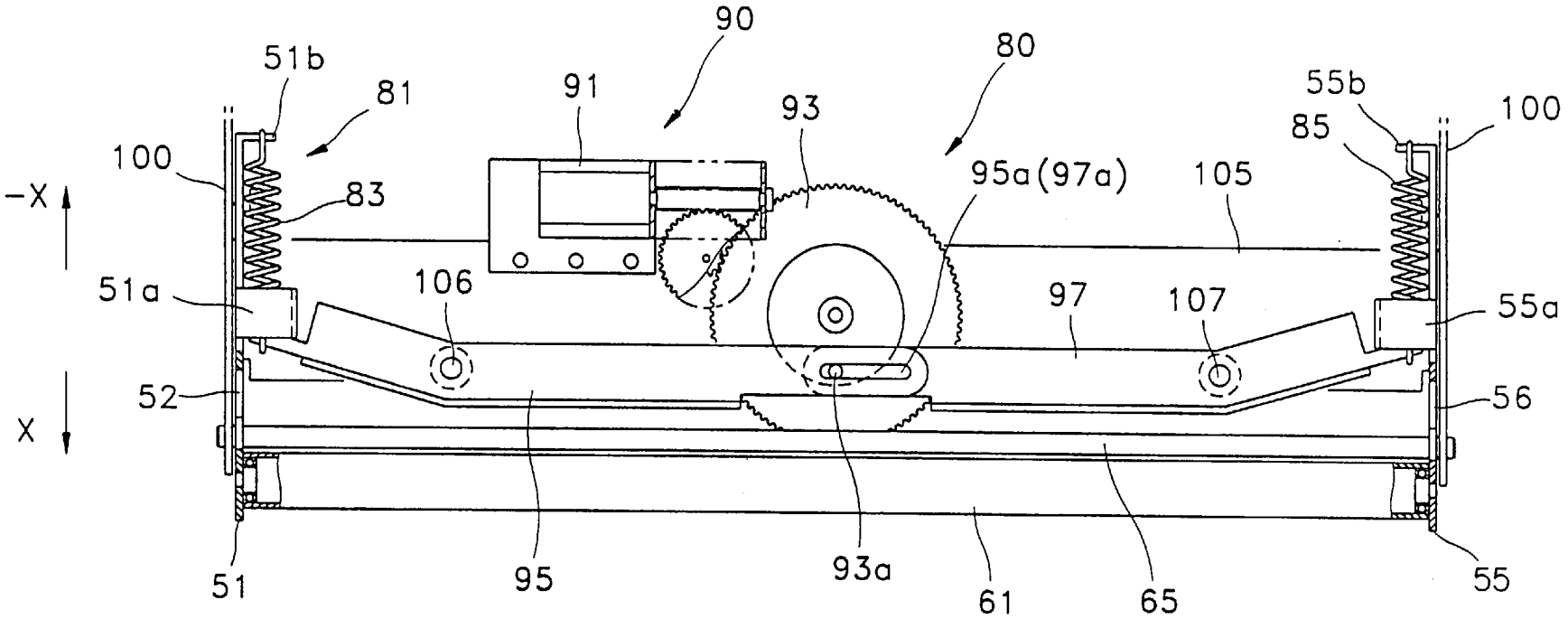
FIG. 13 is a schematic plan view of a photoreceptor belt tension control apparatus positioned to remove tension from a photoreceptor belt, according to the present invention.

FIG. 13 shows the photoreceptor belt tension control apparatus in a position that removes the tension from the photoreceptor belt 10, for example, when the belt frame 100 in the printer main body is replaced or the photoreceptor belt 10 is replaced. Specifically, the driving source 91 rotates the driving plate 93 to locate the driving protrusion 93*a* between the steering roller 61 and the rotational center of the driving plate 93. Thus, the lever members 95 and 97 rotate about the hinges 106 and 107, such that the second ends (the outermost ends) of the lever members 95 and 97 retreat in the direction indicated by arrow -X. Eventually, the second ends (the outermost ends) of the lever members 95 and 97 respectively contact the guide brackets 51*a* and 55*a*, whereafter, further rotation of the lever members 95 and 97 causes the auxiliary frames 51 and 55 to retreat in the direction indicated by arrow –X. Thus, the steering roller 61 retreats in the direction indicated by arrow –X, thereby removing the tension in the photoreceptor belt 10. As described above, the tension in the photoreceptor belt can be easily controlled by the operation of the driving source 91.

The photoreceptor belt control apparatus for a printer according to the present invention has the following effects.

First, a spring force is dispersed by a structure that moves both ends of the steering roller. Thus, a space occupied by the photoreceptor belt control apparatus is miniaturized and compacted.

Second, since the cam unit guides the tilt of the steering roller, the mechanical structure is strengthened, and connection with the driving source is simple.

Third, the auxiliary frames are driven by an internal driving source to adjust the tension in the photoreceptor belt, which facilitates the loading and unloading of the belt frame and replacement of the photoreceptor belt.

The above features of the invention including various and novel details of construction and combination of parts has been particularly described with reference to the accompanying drawings and are pointed out in the claims. It will be understood that the particular photoreceptor belt control apparatus embodying the invention is shown by way of illustration only and not as a limitation of the invention. The principles and features of this invention may be employed in varied and numerous embodiments without departing from the scope of the invention.

What is claimed is:

1. A photoreceptor belt control apparatus for a printer with a photoreceptor belt that circulates around rollers, the apparatus comprising:

a belt frame;

a pair of auxiliary frames slidably and pivotally installed on the belt frame;

a steering roller rotatably installed between the auxiliary frames, the steering roller rotating in contact with the photoreceptor belt;

a shaft rotatably installed on the belt frame;

a cam unit installed on at least one end of the shaft, that controls an inclination of the steering roller by pivoting one of the auxiliary frames according to a rotational position of the shaft;

a pair of first coupling protrusions protruding from the belt frame;

a pair of second coupling protrusions respectively protruding from the auxiliary frames;

a pair of elastic members, for elastically biasing the auxiliary frames with respect to the belt frame, one of the elastic members having ends respectively coupled to one of the first and one of the second coupling protrusions, and the other elastic member having ends respectively coupled to the other of the first and the other of the second coupling protrusions;

a driving mechanism for selectively regulating an elastic force applied to the auxiliary frames by the pair of elastic members; and a pair of guide slots respectively formed in the auxiliary frames, wherein the first coupling protrusions protrude from the belt frame and respectively through the guide slots, the first coupling protrusions being the respective pivot centers of the auxiliary frames.

2. The photoreceptor belt control apparatus as claimed in claim 1, wherein the cam unit comprises:

a cam member installed on the at least one end of the shaft; and an elevating guide hole formed on at least one of the auxiliary frames, receiving the cam member, and having opposed surfaces contacting the outer circumference of the cam member;

wherein the at least one of the auxiliary frames pivots according to the rotation of the cam member to control the inclination of the steering roller.

3. The photoreceptor belt control apparatus as claimed in claim 1, further comprising:

a coupler installed on an end of the shaft, wherein the rotation of the shaft is controlled by an external driving source installed in a printer main body and connected to the coupler.

4. A photoreceptor belt control apparatus for a printer with a photoreceptor belt that circulates around rollers, the apparatus comprising:

a belt frame;

a pair of auxiliary frames slidably and pivotally installed on the belt frame;

a steering roller rotatably installed between the auxiliary frames, the steering roller rotating in contact with the photoreceptor belt;

a shaft rotatably installed on the belt frame;

a cam unit installed on at least one end of the shaft, that controls an inclination of the steering roller by pivoting one of the auxiliary frames according to a rotational position of the shaft;

an elastic biasing means for elastically biasing the auxiliary frames with respect to the belt frame;

a fixing plate installed on the belt frame;

a driving plate rotatably installed on the fixing plate;

a driving source that provides a driving force to rotate the driving plate; and a pair of lever members pivotally mounted on the fixing plate, for selectively regulating the elastic force applied to the auxiliary frames by the elastic biasing means, the lever members having first ends respectively coupled to the driving plate and second ends that, depending on a position of the driving plate, respectively abut against the auxiliary frames and respectively move the auxiliary frames in a direction to reduce the tension in the photoreceptor belt.

5. The photoreceptor belt control apparatus as claimed in claim 4, wherein the elastic biasing means comprises:

a pair of coupling protrusions respectively extending from the auxiliary frames; and a pair of elastic members, one of the elastic members having ends respectively coupled to one of the coupling protrusions and the second end of one of the lever members, and the other elastic member having ends respectively coupled the other coupling protrusion and the second end of the other lever member.

6. The photoreceptor belt control apparatus as claimed in claim 4, wherein the elastic biasing means comprises:

a pair of first coupling protrusions extending from the belt frame;

a pair of second coupling protrusions respectively extending from the auxiliary frames; and a pair of elastic members, one of the elastic members having ends respectively coupled to one of the first and one of the second coupling protrusions, and the other elastic member having ends respectively coupled to the other of the first and the other of the second coupling protrusions.

7. The photoreceptor belt control apparatus as claimed in claim 6, further comprising:

a pair of guide slots respectively formed in the auxiliary frames, wherein the first coupling protrusions protrude from the belt frame and respectively through the guide slots, the first coupling protrusions being the respective pivot centers of the auxiliary frames.

8. The photoreceptor belt control apparatus as claimed in claim 4, wherein the auxiliary frames further comprise:

guide brackets respectively protruding from the auxiliary frames so as to respectively contact the second ends of the lever members.

9. The photoreceptor belt control apparatus as claimed in claim 8, wherein the elastic biasing means comprises:

a pair of coupling protrusions respectively extending from the auxiliary frames; and a pair of elastic members, one of the elastic members having ends respectively coupled to one of the coupling protrusions and the second end of one of the lever members, and the other elastic member having ends respectively coupled the other coupling protrusion and the second end of the other lever member.

10. The photoreceptor belt control apparatus for a printer as claimed in claim 8, wherein the elastic biasing means comprises:

a pair of first coupling protrusions extending from the belt frame;

a pair of second coupling protrusions respectively extending from the auxiliary frames; and a pair of elastic members, one of the elastic members having ends respectively coupled to one of the first and one of the second coupling protrusions, and the other elastic member having ends respectively coupled to the other of the first and the other of the second coupling protrusions.

11. The photoreceptor belt control apparatus as claimed in claim 10, further comprising:

a pair of guide slots respectively formed in the auxiliary frames, wherein the first coupling protrusions protrude from the belt frame and respectively through the guide slots, the first coupling protrusions being the respective pivot centers of the auxiliary frames.

12. The photoreceptor belt control apparatus as claimed in claim 4, wherein the cam unit comprises:

a cam member installed on the at least one end of the shaft; and an elevating guide hole formed on at least one of the auxiliary frames, receiving the cam member, and having opposed surfaces contacting the outer circumference of the cam member;

wherein the at least one of the auxiliary frames pivots according to the rotation of the cam member to control the inclination of the steering roller.

13. The photoreceptor belt control apparatus as claimed in claim 4, further comprising:

a coupler installed on an end of the shaft, wherein the rotation of the shaft is controlled by an external driving source installed in a printer main body and connected to the coupler.

* * * * *